US006779986B1

(12) United States Patent
Breuer et al.

(10) Patent No.: US 6,779,986 B1
(45) Date of Patent: Aug. 24, 2004

(54) RADIAL PISTON PUMP

(75) Inventors: Peter Breuer, Friedrichsdorf (DE); Bernd Denfeld, Bad Homburg (DE); Axel Fassbender, Offenbach (DE); Antonia Schlosshan, Frankfurt (DE)

(73) Assignee: LUK Fahrzeug-Hydraulik GmbH & Co. KG (DE)

( * ) Notice: Subject to any disclaimer, the term of this patent is extended or adjusted under 35 U.S.C. 154(b) by 0 days.

(21) Appl. No.: 10/129,450

(22) PCT Filed: Oct. 28, 2000

(86) PCT No.: PCT/EP00/10640

§ 371 (c)(1),
(2), (4) Date: Aug. 13, 2002

(87) PCT Pub. No.: WO01/33077

PCT Pub. Date: May 10, 2001

(30) Foreign Application Priority Data

Nov. 4, 1999 (DE) ..... 199 53 248

(51) Int. Cl.[7] ..... F04B 1/04; F04B 27/04

(52) U.S. Cl. ..... 417/273; 417/545; 91/472; 92/12.1

(58) Field of Search ..... 417/273, 470, 417/495, 545, 569, 570; 92/12.1; 91/472, 473, 493

(56) References Cited

U.S. PATENT DOCUMENTS 4,915,595 A * 4/1990 Nelson et al. ..... 417/273
5,171,135 A * 12/1992 Gannaway et al. ..... 417/550
5,207,771 A * 5/1993 Sugisaw et al. ..... 92/72
5,383,770 A * 1/1995 Hisahara ..... 417/273
5,476,371 A * 12/1995 Dreiman ..... 417/550
5,564,909 A 10/1996 Rischen et al. ..... 417/273
5,626,466 A * 5/1997 Ruoff et al. ..... 417/273
5,951,261 A * 9/1999 Paczuski ..... 417/315

FOREIGN PATENT DOCUMENTS

DE 3231878 11/1983 ..... 417/273
DE 4419927 12/1995

* cited by examiner

*Primary Examiner*—Justine R. Yu
*Assistant Examiner*—Han L Liu
(74) *Attorney, Agent, or Firm*—Ostrolenk, Faber, Gerb & Soffen, LLP

(57) ABSTRACT

The invention relates to a radial piston pump, comprising an inlet chamber with an inlet connection, an eccentric which may be driven in a rotating manner, arranged within the inlet chamber, for driving at least one piston of the radial piston pump, a cylinder bore for guiding the piston and an inlet controller, which opens and closes a connection between the inlet chamber and the cylinder bore, depending on the piston position. The radial piston pump is characterized by at least one balancing element (24, 25) for the eccentric (17), which rotates synchronously with the eccentric (17) in the inlet chamber (20), the balancing element (24, 25) being so arranged in the inlet chamber (20) and/or so formed in its contour that a hydraulic resistance is formed between the inlet connection (8') and inlet controller (31), or the flow of medium reaching the inlet controller (31) is unaffected.

20 Claims, 3 Drawing Sheets

RADIAL PISTON PUMP

Figure 1:
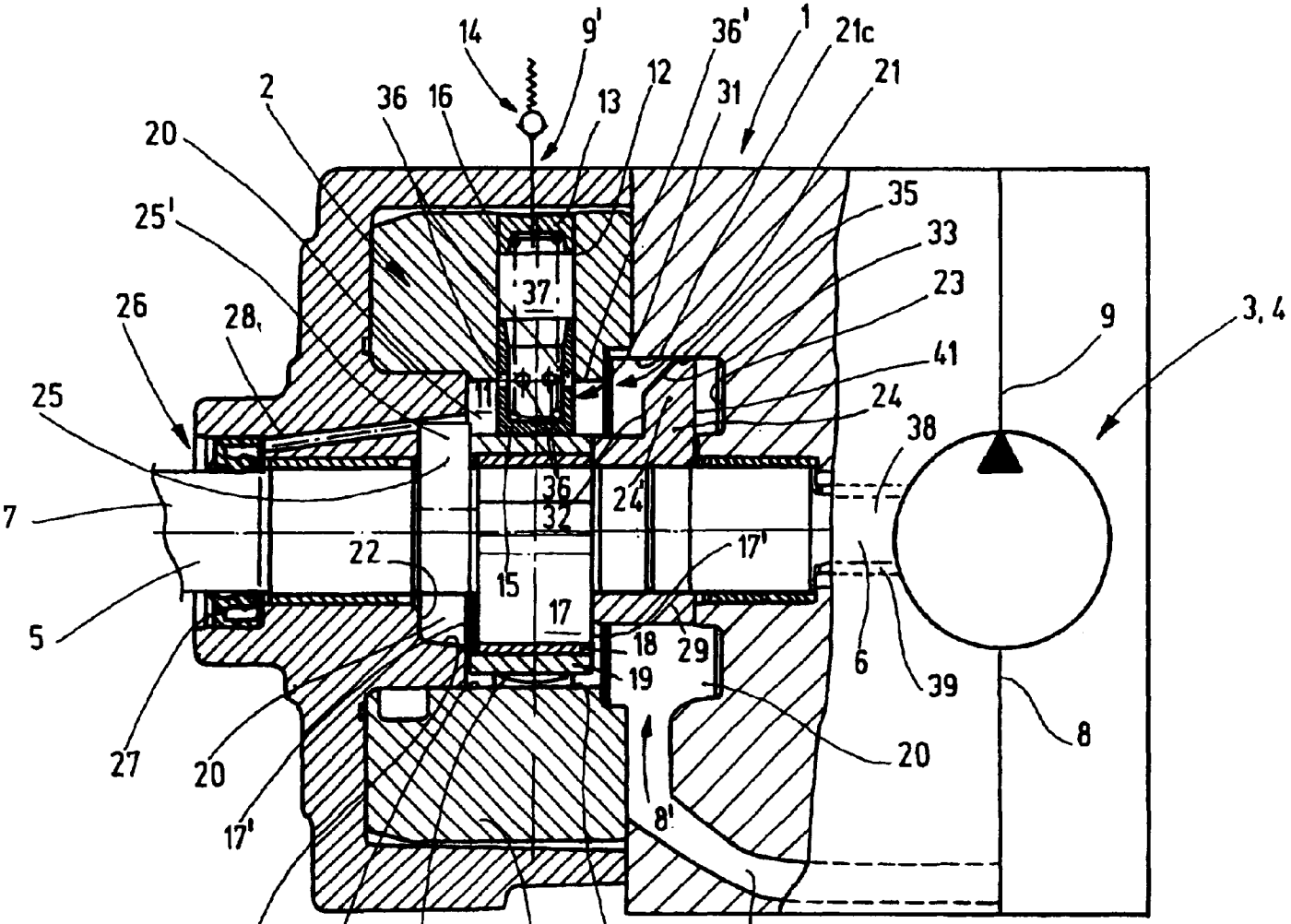

The invention relates to a radial piston pump in which balancing of the drive shaft eccentric and modifying the flow characteristics of the incoming fluid are implemented in an improved manner.

A radial piston pump of the generic type is disclosed by DE 32 31 878 C1. Such radial piston pumps, also referred to as bottom inlet radial piston pumps, have an inlet chamber in which there is arranged an eccentric which may be driven in a rotating manner for driving at least one piston. Furthermore, this radial piston pump has an inlet controller which opens or closes a connection between the inlet chamber and cylinder bore, depending on the piston position. Also arranged concentrically on the drive shaft bearing the eccentric is a disk that influences the intake stream. The diameter of the disk is selected such that there is a relatively small gap between the wall bounding the inlet chamber radially and the disk, so that a restrictor gap is formed -as viewed over the entire circumference of the disk.

U.S. Pat. No. 5,207,771 A discloses a radial piston pump which has balancing elements which are intended to compensate for imbalance caused by the eccentric. However, this known pump does not have a bottom inlet, which means that the eccentric and the balance weight are not arranged in the chamber which also forms the inlet chamber.

It is therefore an object of the invention to specify a radial piston pump of the type mentioned at the beginning in which exerting an influence on the inlet medium flow and balancing are implemented in a simple manner.

This object is achieved by a radial piston pump which has an inlet chamber comprising an inlet connection and an eccentric which can be driven in a rotating manner, arranged within the inlet chamber, for drive al least one piston of the radial piston-pump. In addition, it has a cylinder bore guiding the piston and an inlet controller which opens or closes a connection between the inlet chamber and the cylinder bore, depending on the piston position. According to the invention, the radial piston pump is distinguished by a balancing element for the eccentric, which rotates synchronously with the eccentric in the inlet chamber, whereby the balancing element is so arranged in the inlet chamber and/or its contour is so designed that a hydraulic resistance is formed between the inlet connection and the inlet controller, or the flow of medium to the inlet controller is unaffected. Surprisingly, it has been shown that, in order to exert an influence on the inlet medium flow, it is not necessary to use a circular disk, as proposed in DE 32 31 878 C1 mentioned above. Surprisingly, it has also been shown that a balancing element which does not form a circulating sealing gap with the wall of the inlet chamber permits an influence to be exerted on the inlet medium flow, so that the delivery characteristic of the radial piston pump can be varied. Depending on how the balancing element is arranged in the inlet chamber, the medium flow reaching the inlet controller can be restricted or can flow substantially unimpeded. If for example, the distance between the balancing element and the inlet controller and/or the inlet connection is chosen to be relatively small, a falling delivery characteristic can be achieved. On the other hand, if this distance is chosen to be sufficiently large, the medium flow reaching the inlet controller is substantially unaffected. The radial piston pump according to the invention therefore has, if necessary, a virtually unchanged delivery characteristic, but provides the advantage of compensating for the imbalance caused by the eccentric. As mentioned above, however, tho medium flow reaching the inlet controller can also be influenced by the contour of the balancing element. For example, provision can be made for the balancing element to taper in the radial direction, in order in the region of the inlet controller and/or the inlet connection to have a greater distance from the latter, so that as a result the medium flow is unaffected.

In a particularly preferred exemplary embodiment, the radial piston pump is designed to be inlet-restricted. Inlet-restricted radial piston pumps provide the advantage that, up to a specific speed of the drive shaft or of the eccentric, they have a rising delivery characteristic and, from this specific speed, also referred to as the limiting speed they have a horizontal delivery characteristic. In order not to lose this advantageous effect, provision is made, in particular in inlet-throttled radial piston pumps, for the balancing element to be arranged in the inlet chamber and/or for its contour to be so designed that the medium flow reaching the inlet controller is substantially unaffected. It is therefore possible, by using the balancing element according to the invention, to provide a bottom-inlet, inlet-restricted radial piston pump which has very low or no vibration and nevertheless has an unaffected delivery characteristic, that is to say above the predefinable limiting speed, substantially has a horizontal delivery characteristic. This radial piston pump is used in particular to supply a hydraulic system which actively influences the chassis of a motor vehicle.

A preferred exemplary embodiment is distinguished by the fact that the balancing element has a chamfer on its side facing the inlet controller, so that the thickness of the balancing element decreases radially outward. It has been shown that a balancing element designed in this way substantially does not affect the inlet medium flow to the inlet controller. In one exemplary embodiment, provision is made for the balancing element to comprise a disk segment. Alternatively, provision can be made for a disk to be provided which arranged with its mid-axis offset in relation to the eccentric. The balancing element therefore has a mass element which is associated with the eccentric in such a way that the unbalance caused by the eccentric is compensated.

In a preferred exemplary embodiment, provision is made for the eccentric and the balancing element to be arranged on a drive shaft which turns or rotates in the inlet chamber. Provision can be made for the eccentric to be formed in one piece with the drive shaft. In this case, the mid-axis of the balancing element does not coincide with the longitudinal axis of the drive shaft.

In order to achieve dynamic balancing, provision is made for a second balancing element to rotate synchronously with the eccentric. The two balancing elements are so oriented with respect to the eccentric that during the rotation of the drive shaft a couple is formed which compensates for the imbalance orienting from the eccentric, the two balancing elements being so arranged and so formed with respect to their mass that tilting moments caused by imbalance outside the mid-plane of the eccentric are also compensated.

According to one exemplary embodiment, at least one ofthe two balancing elements can be fitted to the drive shaft. In other words, at least one of the two balancing elements is pushed onto the drive shaft, the balancing element having an aperture whose internal diameter is so chosen that the balancing element is held firmly on the drive shaft.

According to another exemplary embodiment, provision is made for one of the two balancing elements to be formed in one piece with the drive shaft and for the other balancing element to be able to be fitted to the drive shaft. These configurations are provided in particular when the eccentric has a DU bush and a steel bush, which are pushed onto the eccentric contour. The steel bush co-operates with the piston crown of the at least one piston. The fact that a balancing element can be fitted to the drive shaft means that this preferably hardened steel bush and the inner DU bush can be pushed onto the eccentric first, so that the balancing element can then be fitted to the drive shaft. Here, the balancing elements are fitted to the drive shaft in such a way that the steel bush and the DU bush cannot slip off the eccentric.

According to a development of the invention, provision is made for the first balancing element to have a hub through which the drive shaft passes, the disk segment protruding from the hub. Instead of the disk segment, a circular disk can also be provided. This disk or the disk segment is used as a balance weight, which has an offset with respect to the mid-axis of the hub.

The axial length of the balancing element is particularly preferably dimensioned such that it bears with its one end on the side surface of the eccentric and with its other end on a wall bounding the inlet chamber. As a result, the drive shaft is fixed axially. A separate thrust disk can therefore be omitted.

In an advantageous development, the drive shaft passes through this wall bounding the inlet chamber and, with its free end, co-operate with a rotor of a second pump, in particular a vane pump. The drive shaft therefore drives both the radial piston pump and the second pump.

One exemplary embodiment is distinguished by the fact that the balancing element has, on its side facing the wall of the inlet chamber, a recess which is oriented radially outward and which forms a lubrication groove. The balancing element therefore serves simultaneously as a thrust disk, as it is known, a film of lubricant being formed between the balancing element and the wall bounding the inlet chamber.

In a preferred exemplary embodiment, provision is made for the inlet controller to comprise a control edge located in the opening area of the cylinder bore and at least one aperture located in the piston wall. The inlet controller is therefore preferably located in the inlet chamber. Depending on the piston position, this aperture is covered or opened by the control edge, so that the medium can be taken in via this aperture and therefore enters the cylinder, in order to be forced out of the cylinder again during a further piston movement.

Further refinements emerge from the subclaims.

The invention will be explained in more detail below using exemplary embodiments and with reference to the drawing, in which:

FIG. 1 shows a radial piston pump with two balancing elements, and

Figure 2:
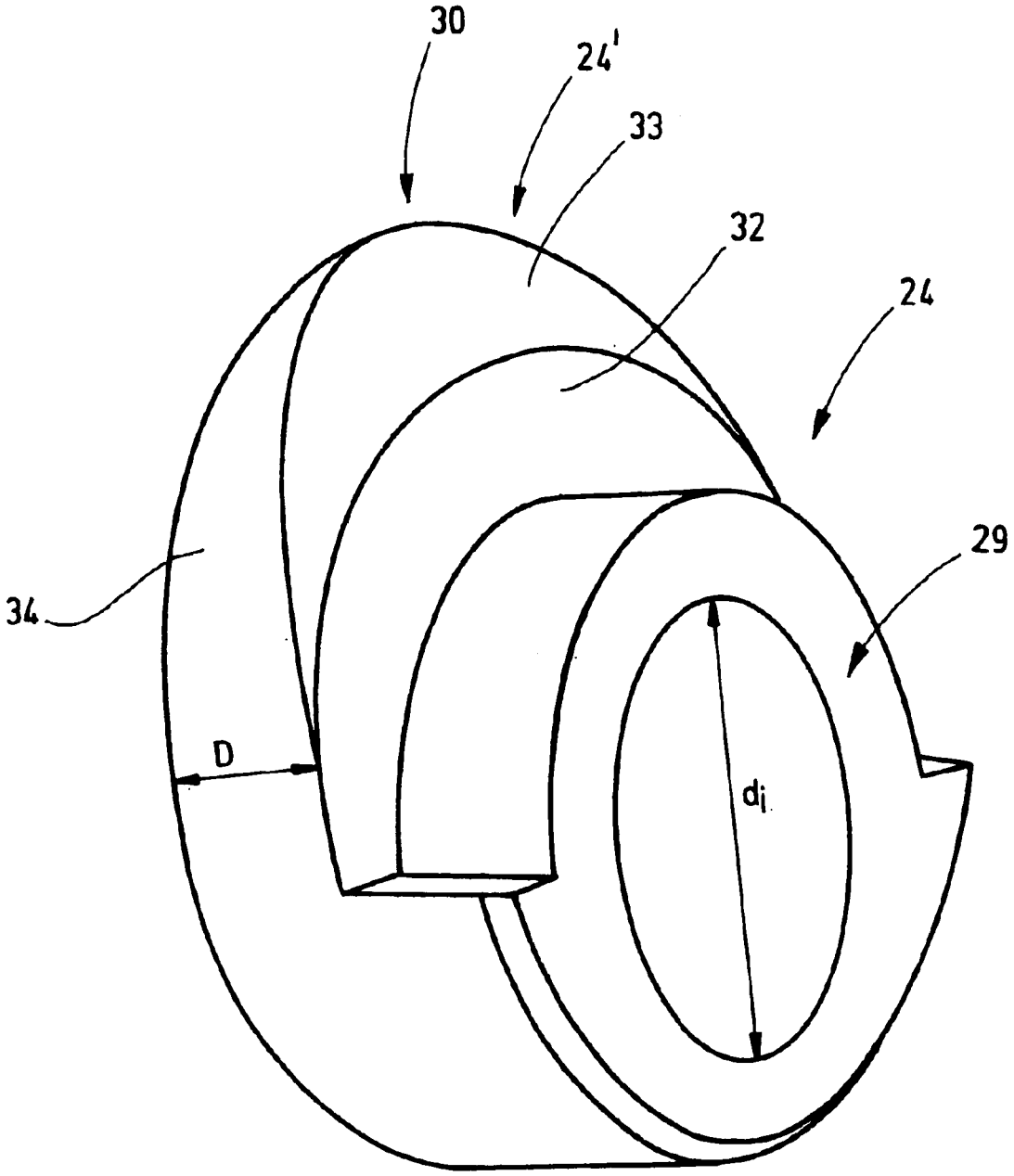
Figure 3:
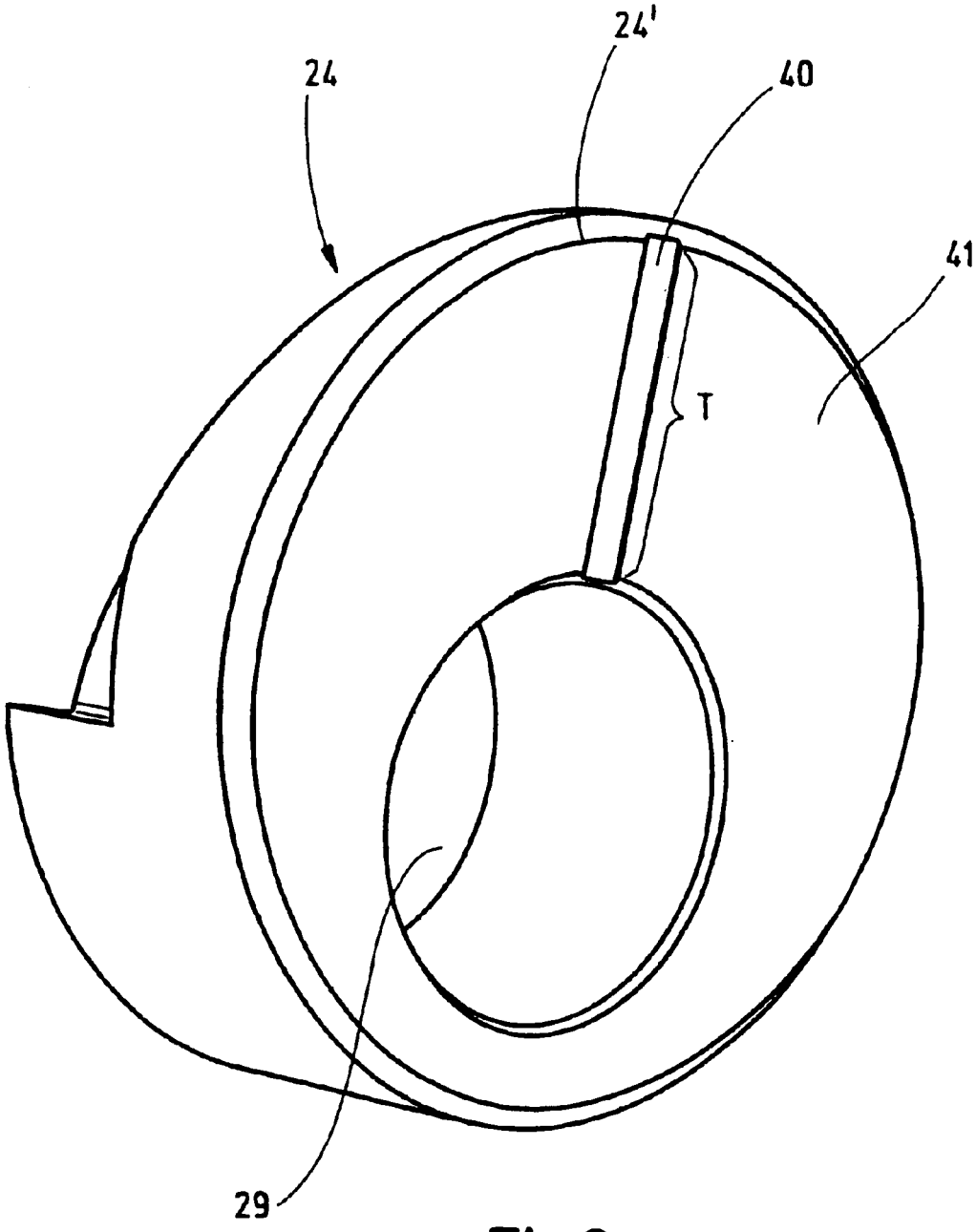

FIGS. 2 and 3 each show a perspective view of a balancing element.

FIG. 1 shows a pump casing, in which at least one radial piston pump 2 is arranged. In the exemplary embodiment shown, a second piston pump 3, which can be designed as a vane pump 4, is arranged in the pump casing 1. The radial piston pump 2 has a drive element 5. The vane pump likewise has a drive element 6. Provision is preferably made for the two drive element 5 and 6 to be formed by a common drive shaft 7, into which a drive torque can be introduced. Each pump 2, 3 has an inlet connection 8' and 8, respectively, and a delivery connection 9' and 9. The two inlet connections 8 and 8' can be led together in a common connection duct 8" in the pump housing 1. The two pumps 2 and 3 can then deliver from a common reservoir.

The radial piston pump 2 has a cylinder block 10, in which one or more pistons 11 are guided in a cylinder bore 12. The cylinder bore 12 is closed by a plug 13 at its end facing away from the drive shaft 7. The delivery connection 9' can open in the plug 13 or in the wall of cylinder bore 12 and can also be assigned an outlet controller 14. A spring element 16 is supported by its one end on the inner side of the piston crown 15 of the pot-like piston 11. With its other end, the spring element 16 bears on the plug 13, so that the piston 11 is urged in the direction of the drive shaft 7. On the outer side of the piston crown 15 there acts an eccentric 17, which is driven in a rotating manner by the drive shaft 7 and therefore displaces the piston 11 in the cylinder bore. The eccentric 17 can be formed in one piece with the drive shaft 7 or pushed on in a rotationally fixed manner. Fitted to the eccentric 17 is an intermediate bush 18, for example a DU bush, which is surrounded by a hardened steel bush 19, so that the outer side of the piston crown 15 cooperates with the outer side of the steel bush 19. In the case of a DU bush, a Teflon coating is preferably provided on the inner side of the intermediate bush 18, facing the eccentric 17. If the intermediate bush 18 is formed as a DU bush, this slides on the eccentric 17 during the operation of the radial piston pump 2, while the steel bush 19 is stationery.

The eccentric 17 is arranged in an inlet chamber 20 which is preferably stepped—three times here—, can be formed as an annular chamber and is bounded radially by a circumferential wall 21 and axially by side walls 22 and 23. Depending on the number of steps in the inlet chamber 20, the circumferential wall 21 is formed from a plurality of part walls 21*a*, 21*b*, 21*c*. Also located in the inlet chamber 20 are a first and second balancing element 24 and 25, which are intended to compensate for imbalance caused by the eccentric rotation. The two balancing elements 24 and 25 run synchronously with the eccentric 17 and can be formed as balancing eccentrics, the two cams 24' and 25' of the balancing eccentric, that is to say the balancing elements, and the cam of the eccentric 17 being so oriented that they extend substantially in opposite directions.

In the present exemplary embodiment, the second balancing element 25 is formed in one piece with the drive shaft 7. The first balancing element 24 is pressed onto the drive shaft 7. It can be seen that the balancing elements 24 and 25 bear on the side surfaces 17' of the eccentric 17 in such a way that the intermediate bush 18 and the steel bush 19 cannot slip off the eccentric 17. In addition, the balancing elements 24 and 25 have an axial length such that they are supported with their outer side at least in some areas on the side walls 22 and 23 of the inlet chamber 20. The drive shaft 7 is therefore fixed in the axial direction, which is otherwise mounted such that it can slide and, at its passage 26 through the casing, is surrounded by a shaft seal 27, which is connected to the inlet chamber 20 via a duct 28.

The first balancing element 24 will be described in more detail below by using FIGS. 1 and 2. It has a hub 29, whose internal diameter $d_i$ is preferably chosen such that it can be pressed onto the drive shaft 7. The balancing element 24 also comprises a disk segment 30, which serves as a balance weight and forms the cam 24'. On its side 32 facing an inlet controller 31 and the inlet connection 8' (FIG. 1), it has a chamfer 33 radially on the outside, as a result of which the thickness D of the disk segment 30 decreases radially outward.

Instead of the disk segment 30, the balancing implement 24 can also be formed by the hub 29, which is connected to a substantially circular disk 34 or comprises the disk 34, the mid-axes of the hub 29 and the disk 34 not being coincident and, as a result, the cam 24' being formed, which preferably projects beyond the circumferential wall of the hub 29. In both designs, the balancing element 24 therefore has an eccentric form which comprises the cam 24' which serves as a balance weight.

It can be seen from FIG. 1 that the cam 24' of the balancing elements 24 has an axial spacing both from the inlet controller 31 and from the inlet connection 8'. Depending on how this spacing is chosen, the medium flow leading from the inlet connection 8' to the inlet element 31 is affected more or less. If a very large spacing is chosen, as can be seen in FIG. 1, the medium flow from the inlet connection 8' can reach the inlet controller 31 substantially unimpeded. The balancing element 24 therefore substantially forms no hydraulic resistance in the inlet area between inlet opening 8' and inlet controller 31. This effect is further assisted by the chamfer 33. However, provision can also be made for only the chamfer 33 to be provided on the balancing element 24 and for the axial spacing between the cam 24' and the inlet controller 31 or the inlet connection 8' to be chosen to be relatively small. In addition, the thickness D of the disk 34 or of the disk segment 30 can also be varied. Depending on how the balancing element 24 is arranged in the inlet chamber and/or is contoured (chamfer 33, thickness D), it is therefore possible for a hydraulic resistance to be formed between the inlet connection 8' and inlet controller 31. However, it is also possible to so arrange the balancing element in the inlet chamber 20 or to so contour it that the medium flow from inlet connection 8' to inlet controller 31 is substantially unaffected. By means of the arrangement or contouring of the balancing element 24, the course of the delivery characteristic of the radial piston pump 2 can therefore be varied. In the exemplary embodiment of FIG. 1, it can also be seen that the hub 29 bears on the eccentric 17, and the balance weight, that is to say the cam 24', is arranged at a distance from the eccentric 17. However, an arrangement in which the balance weight is located adjacent to the eccentric 17 would also be conceivable.

In the present exemplary embodiment, the inlet controller 31 is formed by a control edge 36', which is present on the cylinder block 10 and surrounds the cylinder bore 12 in its opening area 35 toward the inlet chamber 20. In addition, at least one aperture 36 made in the wall of the piston 11 is associated with the inlet controller 31. It therefore becomes clear that a connection from the inlet connection 8' via the inlet chamber 20 into the piston chamber 37 can be opened or closed, depending on the piston position. Depending on the opening width of the aperture 36 and the distance at which it is arranged in relation to the piston crown 15, an appropriate opening cross section is formed with the control edge 36', so that the radial piston pump 2 can also be designed to be inlet-restricted. The inlet restriction is therefore preferably implemented by means of the inlet controller 31. As can be seen in FIG. 1, it is of course also possible for a plurality of apertures 36 to be arranged in the piston wall.

FIG. 1 further reveals that the drive shaft 7 passes through the wall 23 that bounds the inlet chamber 20 and is designed to be lengthened as far as the second pump 3. At its free end 38, the drive shaft 7 is connected to a rotor (not illustrated here) of the vane pump, 4, so that this rotor can be driven in a rotating manner. In the case of vane pumps, it is known that leakage oil flows away from the pressurized area and, for example, runs together in the shaft channel 39. Since this delivery medium is under pressure, it is able to wander in the shaft channel 39 along the drive shaft 7 in the direction of the balancing element 24. However, a separate discharge channel (not illustrated) for this leakage oil can also be provided, which opens into the side wall 23 of the inlet chamber 20.

As FIG. 3 shows, the balancing element has on its side face 41 facing the side wall 23 a recess 40, which preferably extends over the entire part-length T of this side face 41. Delivery medium from the vane pump 4 which has run together in the shaft channel 39 can therefore migrate radially outward in this recess 40, formed as a groove, and in this way reach the inlet chamber 20 of the radial piston pump 2. At the same time, lubricating oil is therefore also provided between this side face 41 and the side wall 23. If the balancing weight—as previously mentioned—is adjacent to the eccentric 17, then the recess 40 can be made in the base surface, facing the side wall 23, of the hub 29 formed as a hollow cylinder.

It therefore becomes clear that the first balancing element 24, if appropriate with the second balancing element 25, serves for imbalance compensation for the rotating eccentric 17. In addition, with the balancing element 24 according to the invention, the delivery characteristic of the radial piston pump 2 can be influenced. By means of the specific contouring, for example by means of the chamfer 33 and the thickness D of the disk 34 or of the disk segment 30, the delivery characteristic can be influenced, "influencing" in the course of this application being understood to mean that either a hydraulic resistance is formed between the intake connection 8' and the inlet controller 31, or else the medium flow between inlet controller 31 and inlet connection 8' is unaffected. In addition, the balancing element 24 performs the axial fixing of the drive shaft 7, so that it is possible to dispense with a separate thrust disk. For the axial fixing of the drive shaft 7, it is sufficient to match the axial length of the hub 29 to the distance between the side face 17' of the eccentric 17 and the side wall 23 of the inlet chamber 20. The axial length of the hub 29 and the thickness D of the disk 34 or of the disk element 30 may therefore be different. In addition, the lubricating oil which originates from the vane pump 4 can be discharged through the recess 40, which serves as a lubricating groove. The balancing element 24 according to the invention therefore has a multiple function.

The patent claims filed with the application are proposed formulations without prejudice for the achievement of more extensive patent protection. The applicant reserves the right to claim still further features, as yet disclosed only in the description and/or drawing.

Back references used in subclaims point to the further development of the subject of the main claim by means of the features of the respective subclaim; they are not to be understood as dispensing with the achievement of independent, concrete protection for the features of the subclaims making such back references.

However, the subjects of these subclaims also form independent inventions, which have a structure independent of the subjects of the preceding subclaims.

Nor is the invention restricted to the exemplary embodiments of the description. Instead, within the scope of the invention, numerous amendments and modifications, in particular those variants, elements and combinations and/or materials which are inventive, for example as the result of combination or modification of individual features or elements or method steps with those described in the general description and embodiments and in the claims and contained in the drawings and, by means of features which can be combined, lead to a new subject or to new method steps or sequences of method steps, including those which to this extent relate to the production, testing and working methods.

What is claimed is:

1. A radial piston pump comprising:

a casing, an inlet chamber in the casing, an inlet passage connected to the inlet chamber;

a cylinder in the casing for guiding a piston to move radially;

at least one piston oriented in the cylinder;

a rotatable eccentric in the casing which moves the piston radially as the eccentric rotates;

an inlet controller coupled to the cylinder for the piston, the controller being operative to open and close a connection between the inlet chamber and the cylinder depending upon the radial position of the piston within the cylinder;

a balancing element positioned within the inlet chamber and configured to rotate synchronously with the eccentric for balancing the eccentric on the shaft, the balancing element being so oriented within the inlet chamber and/or so shaped that the balancing element provides a selected resistance to a flow of fluid from the inlet chamber to the cylinder.

2. The radial piston pump of claim 1, further comprising an inlet restriction to the inlet chamber.

3. The radial piston pump of claim 1, wherein the balancing element is spaced at a distance from at least one of the inlet controller and the inlet connection.

4. The radial piston pump of claim 1, wherein the balancing element comprises a balanced weight forming a cam.

5. The radial piston pump of claim 1, further comprising a drive shaft rotatable in the inlet chamber, the eccentric and the balancing element being arranged on the drive shaft to rotate therewith.

6. The radial piston pump of claim 5, further comprising a second balancing element spaced from the first balancing element and also rotatable synchronously with the eccentric.

7. The radial piston pump of claim 6, wherein at least one of the first and second balancing elements can be fitted to the drive shaft.

8. The radial piston pump of claim 1, further comprising a second balancing element spaced from the first balancing element and also rotatable synchronously with the eccentric.

9. The radial piston pump of claim 1, wherein the balancing element is at least one of oriented within the inlet chamber and shaped to resist the flow of fluid from the inlet chamber to the cylinder.

10. The radial piston pump of claim 1, wherein the balancing element is at least one of oriented within the inlet chamber and shaped so that the balancing element does not resist the flow of fluid from the inlet chamber to the cylinder.

11. A radial piston pump comprising:

a casing, an inlet chamber in the casing, an inlet passage connected to the inlet chamber;

a cylinder in the casing for guiding a piston to move radially;

at least one piston oriented in the cylinder;

a rotatable eccentric in the casing which moves the piston radially as the eccentric rotates;

an inlet controller connected to the cylinder for the piston, the controller being operative to open and close a connection between the inlet chamber and the cylinder depending upon the radial position of the piston within the cylinder;

a balancing element positioned within the inlet chamber and configured to rotate synchronously with the eccentric for balancing the eccentric on the shaft, the balancing element being so oriented within the inlet chamber and/or so shaped that the balancing element provides a selected resistance to a flow of fluid from the inlet chamber to the cylinder;

wherein the balancing element has a first side facing the inlet controller, a chamfer on the first side of the balancing element and is oriented so that the thickness of the balancing element decreases radially outwardly.

12. The radial piston pump of claim 11, wherein the balancing element comprises a balanced weight forming a cam.

13. A radial piston pump comprising:

a casing, an inlet chamber in the casing, an inlet passage connected to the inlet chamber;

a cylinder in the casing for guiding a piston to move radially;

at least one piston oriented in the cylinder;

a rotatable eccentric in the casing which moves the piston radially as the eccentric rotates;

an inlet controller coupled to the cylinder for the piston, the controller being operative to open and close a connection between the inlet chamber and the cylinder depending upon the radial position of the piston within the cylinder;

a balancing element positioned within the inlet chamber and configured to rotate synchronously with the eccentric for balancing the eccentric on the shaft; the balancing element being of so oriented within the inlet chamber and and/or so shaped that the balancing element controllably provides a selected resistance to a flow of fluid from the inlet chamber to the cylinder;

a drive shaft rotatable in the inlet chamber, the eccentric and the balancing element being arranged on the drive shaft to rotate therewith; and a second balancing element spaced from the first balancing element and also rotatable synchronously with the eccentric, wherein the second balancing element comprises a unitary part of the drive shaft and the first balancing element is fitted to the drive shaft.

14. A radial piston pump comprising:

a casing, an inlet chamber in the casing, an inlet passage connected to the inlet chamber;

a cylinder in the casing for guiding a piston to move radially;

at least one piston oriented in the cylinder;

a rotatable eccentric in the casing which moves the piston radially as the eccentric rotates;

an inlet controller coupled to the cylinder for the piston, the controller being operative to open and close a connection between the inlet chamber and the cylinder depending upon the radial position of the piston within the cylinder;

a balancing element positioned within the inlet chamber and configured to rotate synchronously with the eccentric for balancing the eccentric on the shaft; and wherein:

the balancing element comprises a balanced weight forming a cam;

the balancing element is so oriented within the inlet chamber and/or so shaped that the balancing element provides a selected resistance to a flow of fluid from the inlet chamber to the cylinder; and the cam of the balancing element protrudes from a hub on the balancing element.

15. The radial piston pump of claim 14, wherein the balancing element and the hub have end faces and an axial length between the end faces, and the axial length of the balancing element and the hub is dimensioned so that one end face bears on the eccentric and the other end face bears on a side wall bounding the inlet chamber.

16. A radial piston pump comprising:

a casing, an inlet chamber in the casing;

an inlet passage connected to the inlet chamber;

a cylinder in the casing for guiding a piston to move radially;

at least one piston oriented in the cylinder;

a rotatable eccentric in the casing which moves the piston radially as the eccentric rotates;

an inlet controller coupled to the cylinder for the piston, the controller being operative to open and close a connection between the inlet chamber and the cylinder depending upon the radial position of the piston within the cylinder; and a balancing element positioned within the inlet chamber and configured to rotate synchronously with the eccentric for balancing the eccentric on the shaft; the balancing element being so oriented within the inlet chamber and/or so shaped that the balancing element provides a selected resistance to a flow of fluid from the inlet chamber to the cylinder, and wherein the balancing element has end faces and an axial length between the end faces, and the axial length of the balancing element is dimensioned so that one end face bears on the eccentric and the other end face bears on a side wall bounding the inlet chamber.

17. A radial piston pump comprising:

a casing, an inlet chamber in the casing, an inlet passage connected to the inlet chamber;

a cylinder in the casing for guiding a piston to move radially;

at least one piston oriented in the cylinder;

a rotatable eccentric in the casing which moves the piston radially as the eccentric rotates;

an inlet controller coupled to the cylinder for the piston, the controller being operative to open and close a connection between the inlet chamber and the cylinder depending upon the radial position of the piston within the cylinder;

a balancing element positioned within the inlet chamber and configured to rotate synchronously with the eccentric for balancing the eccentric on the shaft; the balancing element being so oriented within the inlet chamber and/or so shaped that the balancing element provides a selected resistance to a flow of fluid from the inlet chamber to the cylinder;

a drive shaft rotatable in the inlet chamber, the eccentric and the balancing element being arranged on the drive shaft to rotate therewith;

the inlet chamber being bounded by a side wall and having the drive shaft passing therethrough; and a second pump spaced from the first pump which is also driven by the driveshaft.

18. The radial piston pump of claim 17, wherein the second pump is a vane pump having a rotor and the drive shaft drives the rotor.

19. A radial piston pump comprising:

a casing, an inlet chamber in the casing, an inlet passage connected to the inlet chamber;

a cylinder in the casing for guiding a piston to move radially;

at least one piston oriented in the cylinder;

a rotatable eccentric in the casing which moves the piston radially as the eccentric rotates;

an inlet controller coupled to the cylinder for the piston, the controller being operative to open and close a connection between the inlet chamber and the cylinder depending upon the radial position of the piston within the cylinder;

a balancing element positioned within the inlet chamber and configured to rotate synchronously with the eccentric for balancing the eccentric on the shaft; the balancing element being so oriented within the inlet chamber and/or so shaped that the balancing element provides a selected resistance to a flow of fluid from the inlet chamber to the cylinder, wherein the balancing element has a side facing a side wall of the inlet chamber and the balancing element has a recess in the side thereof that runs radially outwardly to form a lubricating flow groove.

20. A radial piston pump comprising:

a casing, an inlet chamber in the casing, an inlet passage connected to the inlet chamber;

a cylinder in the casing for guiding a piston to move radially;

at least one piston oriented in the cylinder;

a rotatable eccentric in the casing which moves the piston radially as the eccentric rotates;

an inlet controller connected to the cylinder for the piston, the controller being operative to open and close a connection between the inlet chamber and the cylinder depending upon the radial position of the piston within the cylinder;

wherein the inlet controller comprises a control edge located in an open area of the cylinder bore and at least one aperture located in the piston wall which is opened and closed by the control edge as the piston moves;

a balancing element positioned within the inlet chamber and configured to rotate synchronously with the eccentric for balancing the eccentric on the shaft; the balancing element being so oriented within the inlet chamber and/or shaped so that the balancing element provides a selected resistance to a flow of fluid from the inlet chamber to the cylinder.

* * * * *